US005531795A

United States Patent [19]

Rasmussen et al.

[11] Patent Number: 5,531,795

[45] Date of Patent: Jul. 2, 1996

[54] METHOD FOR CASEIN FINISHING OF LEATHER

[75] Inventors: Lars Rasmussen, Allerød; Annette Møllgaard, Hellerup; Bent R. Petersen, København; Niels H. Sørensen, Skævinge, all of Denmark

[73] Assignee: Novo Nordisk A/S, Bagsvaerd, Denmark

[21] Appl. No.: 432,152

[22] PCT Filed: Dec. 8, 1993

[86] PCT No.: PCT/DK93/00412

§ 371 Date: Jul. 10, 1995

§ 102(e) Date: Jul. 10, 1995

[87] PCT Pub. No.: WO94/13839

PCT Pub. Date: Jun. 23, 1994

[30] Foreign Application Priority Data

Dec. 10, 1992 [DK] Denmark ..... 1484/92

[51] Int. Cl.[6] ..... C14C 11/00

[52] U.S. Cl. ..... 8/94.21; 8/94.18; 427/338; 427/389; 252/8.57; 428/478.2; 428/473

[58] Field of Search ..... 8/94.21, 94.18, 8/94.33; 427/389, 338; 252/8.57; 435/265; 428/478.2, 473

[56] References Cited

U.S. PATENT DOCUMENTS

| | | | |
|---|---|---|---|
| 2,003,065 | 5/1935 | Boyce | 428/478.8 |
| 2,191,654 | 2/1940 | Haon | 8/94.21 |
| 3,939,040 | 2/1976 | Monsheimer et al. | 8/94.16 |
| 4,374,872 | 2/1983 | Eckert et al. | 8/94.21 |
| 4,908,239 | 3/1990 | Lach et al. | 8/94.21 |
| 5,102,422 | 4/1992 | Christner et al. | 8/94.15 |
| 5,428,014 | 6/1995 | Labroo et al. | 514/12 |

FOREIGN PATENT DOCUMENTS 58-149645 9/1983 Japan .

*Primary Examiner*—Prince Willis, Jr.
*Assistant Examiner*—Alan D. Diamond
*Attorney, Agent, or Firm*—Steve T. Zelson; Elias J. Lambiris

[57] ABSTRACT

In the method for casein finishing of leather, transglutaminase is added to a casein solution, whereafter the thus formed solution is applied to leather, which is dried. Transglutaminase, which is not toxic, functions as a hardening agent in the method.

4 Claims, No Drawings

METHOD FOR CASEIN FINISHING OF LEATHER

CROSS-REFERENCE TO RELATED APPLICATIONS

This application is a 371 of PCT/DK93/00412 filed Dec. 8, 1993, which is incorporated herein by reference.

The invention comprises a method for casein finishing of leather.

It belongs to the prior art that leather can be supplied with a finish of casein which is hardened by means of a hardening agent, such as an aldehyde, an aziridine or an isocyanate. These prior art hardening agents, however, suffer from the disadvantage that they are toxic or even very toxic. This is a most unwanted disadvantage, because operators in leather finishing plants tend to acquire allergy and have their mucous membranes attacked.

Thus, the purpose of the invention is the provision of a method for casein finishing of leather, in which a hardening agent is used which do not suffer from the above indicated disadvantages.

The method according to the invention for casein finishing of leather is characterized by the fact that transglutaminase is added to a solution of casein or partially decomposed casein, and that the transglutaminase containing solution is applied to leather as a coat, whereafter the finished leather is dried.

Thus, in the method according to the invention transglutaminase is used as the hardening agent. Transglutaminase is not a toxic material.

Usually, the addition of transglutaminase to the solution is carried out at a pH value between 5 and 9 and at a peak temperature between 10° and 50° C.

Transglutaminase of all origins can be used in the invention.

It goes without saying that the concentration of $Ca^{++}$ in the solution should be at least 0.1–10 mmolar in order to secure a satisfactory activity of the transglutaminase.

In this specification with claims partially decomposed casein means a casein (alpha, beta, and/or Kappa casein) with a degree of hydrolysis (DH) up to 15%, the DH being defined e.g. in "Enzymic Hydrolysis of Food Proteins" by Jens Adler-Nissen, Elsevier Applied Science Publishers Ltd., 1986, page 12–13.

In this specification with claims the term "is applied to leather as a coat" covers one or more of the following types of coats: a base coat, a top coat, and an intermediate coat.

It appears from the above that the method according to the invention comprises three steps: 1 ) addition of transglutaminase to the solution, 2) application of the transglutaminase containing solution to leather, and 3) drying of the finished leather. These three steps may be carried out directly after each other, or some time may elapse between steps 1) and 2) and/or step 2) and 3). If some time elapses between steps 1) and 2), and if in step 2) the viscosity of the solution tends to be too high for easy handling, it may be necessary or recommendable to inactivate the transglutaminase in order to prevent any further viscosity increase. After the end of the application step (i.e. step 2)) ordinarily it is not recommended to inactivate the transglutaminase, because the characteristics of the casein finishing are improved with increasing degree of polymerization. During step 3), the drying step, the transglutaminase will be inactivated, however, if the drying is carried out at high temperature. Usually it is preferred to perform step 1 ), wait for around an hour, and then perform step 2), and immediately thereafter step 3).

It is admitted that it also belongs to the prior art that casein can form a gel by addition of transglutaminase, vide unexamined Japanese patent publication no. 58-149645. However, no indication whatsoever is present in this Japanese patent publication that this process can be used in the leather field.

A preferred embodiment of the method according to the invention is characterized by the fact that the solution of casein or partially decomposed casein also contains one or more normal additives in leather finishing compositions. Typical examples of normal additives in leather finishing compositions are polyurethanes (binders or lacquers), acrylates (lacquers), waxes (agents for generation of a wax or silk like feel), emulsifiers and thickening agents, such as Amollan from BASF and Perbon from Henkel, or dulling agents, such as silicate products like Mattierung SN from Sandoz-Quinn. In this manner leather with specially selected properties can be produced.

A preferred embodiment of the method according to the invention is characterized by the fact that transglutaminase is added in an amount corresponding to between 0.01% (w/w) and 2% (w/w) of active transglutaminase protein related to casein protein. If transglutaminase is added in an amount less than 0.01% (w/w) of active transglutaminase protein related to casein protein, hardening of the coat will require an unreasonably long time. Any transglutaminase added in an amount above 2% (w/w) of active transglutaminase protein related to casein protein would be technically uninteresting, because it would not generate any further fixation.

The invention will be illustrated by the following three examples.

Three kinds of casein were used: 1) non denatured casein, i.e. Miprodan 30 from MD Foods, 8260 Viby, Denmark (CAS for short), 2) Episan T05 from Henkel (EPI for short), and 3) Luron from BASF (LU for short).

7.5% casein solutions (calculated on dry matter) with a $Ca^{++}$ concentration of 5 mM and a pH of 7.0 were prepared.

The transglutaminase was factor XIIIa and was added in an amount of 0.4% active transglutaminase protein related to casein protein.

Leather pieces with a size of 14 cm×25 cm were sprayed diagonally 6 times each with a spray pencil at two atmosphere air pressure. As the viscosity varied from product to product and as the viscosity increased due to cross-linking, the amount of finish deposited on the surfaces varied somewhat from piece to piece, with an average of around 10 μm to 100 μm. After application the pieces are left to dry in fume cabinets. At the end of the day all samples were placed in an incubator at 30° C. for the finish to harden 1 and 2 days.

All leather pieces were tested for rubbing fastness with dry and wet felt according to the DIN 53 339 standard. By means of the felt pieces the degree of deposition of dye was determined. The less deposition, the better the quality.

The experimental conditions and the rest results appear from the following table.

| Example | Prior art | Invention | Short designation of experiment | Treatment | Rubbing fastness DIN 53 339 | |
|---|---|---|---|---|---|---|
| | | | | | Rubbing dry | Rubbing wet |
| 1 | X | | CAS + AQ | Spraying casein with 0.1% azeridin hardener | No deposition | Less deposition |
| | | X | CAS 1 | Spraying casein immediately after transglutaminase addition | No deposition | Less deposition |
| 2 | X | | EPI + AQ | Spraying Episan with 0.1% azeridin hardener | No deposition | Deposition |
| | | X | EPI 1 | Spraying Episan immediately after transglutaminase addition | No deposition | Deposition |
| 3 | X | | LU + AQ | Spraying Luron with 0.1% azeridin hardener | No deposition | Deposition |
| | | X | LU 1 | Spraying Luron immediately after transglutaminase addition | No deposition | No deposition |
| | | | LU 2 | Spraying Luron 1 hour after transglutaminase addition | No deposition | No deposition |
| | | | LU 3 | Spraying Luron 2 hours after transglutaminase addition | No deposition | No deposition |
| | | | LU 4 | Spraying Luron 3 hours after transglutaminase addition | No deposition | No deposition |

It appears from the above table that the transglutaminase hardened finishes in no case did exhibit an inferior quality in regard to rubbing fastness in comparison to the prior art finishes.

We claim:

1. A method for casein finishing of a leather, comprising (a) adding a transglutaminase to a solution which comprises a casein or a partially decomposed casein to form a gel;

(b) coating the leather with said gel to form a finished leather; and (c) drying the finished leather.

2. The method according to claim 1, wherein the solution of casein or the partially decomposed casein further comprises one or more normal additives in leather finishing compositions.

3. The method according to claim 1, wherein the transglutaminase is added at a concentration of between 0.01% (w/w) and 2% (w/w) of active transglutaminase protein related to casein protein.

4. The method according to claim 1, wherein the transglutaminase is added at a concentration of between 0.01% (w/w) and 2% (w/w) of active transglutaminase protein relative to casein protein.

* * * * *